United States Patent [19]

Gordon

[11] Patent Number: 4,617,557

[45] Date of Patent: Oct. 14, 1986

[54] MEDICATION COMPLIANCE AID FOR UNIT DOSE PACKAGING

[75] Inventor: Richard E. Gordon, Gales Ferry, Conn.

[73] Assignee: National Patent Development Corporation, New York, N.Y.

[21] Appl. No.: 669,815

[22] Filed: Nov. 8, 1984

[51] Int. Cl.[4] ..... G08B 7/00; B65D 83/04

[52] U.S. Cl. ..... 340/568; 206/534; 206/531

[58] Field of Search ..... 206/531, 533, 534, 528; 221/2, 3, 8; 340/568, 518; 604/404

[56] References Cited

U.S. PATENT DOCUMENTS

| | | | |
|---|---|---|---|
| 4,034,757 | 7/1977 | Glover | 604/404 |
| 4,223,801 | 9/1980 | Carlson | 206/533 |
| 4,361,408 | 11/1982 | Wirtschafter | 340/309.4 X |
| 4,429,792 | 2/1984 | Machbitz | 206/528 |

*Primary Examiner*—James L. Rowland
*Assistant Examiner*—Anne Marie F. Capati
*Attorney, Agent, or Firm*—Cushman, Darby & Cushman

[57] ABSTRACT

A compliance aid for medication including electronic circuitry to remind the patient when the next dose is due, in which removal of a dose of medicine interrupts individual conductors within the medication package and resets a timer and alarm. The electronic circuitry may be integrally housed within an original medication package or the electronic circuitry may be housed so as to be added to an existing medication package. Additionally, a radio telemetry linkup may be established between some electronic circuitry associated with the medication packaging and other electronic circuitry including the timer and alarm system. The compliance aid may be particularly adapted for use with a medication packaging system conventionally known as a blister package, which is a multi-layered strip packaging technique.

9 Claims, 8 Drawing Figures

MEDICATION COMPLIANCE AID FOR UNIT DOSE PACKAGING

This invention is concerned with a system for electronically aiding patient compliance with a desired medication regimen. In particular, a timing and alarm system for use with individually packaged doses of medicine is described.

Lack of substantial patient compliance with established dosage intervals has long been recognized as a major problem in treating illness. Typically in treating a patient, a physician will desire the patient to take a needed drug on a specific schedule. The prescribed (or over-the-counter) medicine is usually obtained from a pharmacist, or the doctor himself, with the actual administration of the drug left to the sole control of the patient.

In general, the physician gives a prescription to a patient who then takes it to a pharmacist to be filled. The prescription provides information to the pharmacist which includes the strength and dosage of a specific drug and the interval between doses. This information is usually repeated by the pharmacist on a label attached to the medication package, or some other means of written instruction is provided for the patient's benefit in conducting self-administration of the drug. Frequently, the patient alone is responsible for compliance with the physician's instructions. Even a well-meaning and conscientious patient may frequently fail to take medication at the desired dosage intervals. This may be true even if the medication package is carried at all times with the patient.

Potential ill effects of lack of compliance with the desired dosage interval may be further compounded if the patient attempts to compensate for missed dosages by taking an increased dose at a later time. Alternatively, the patient may stop taking the medication altogether. Improper dosage may occur whenever the patient has a marginally impaired memory and may not precisely recall taking the medication or correctly judge how much time has elapsed since medicine was last taken.

These noted problems of patient compliance with a specific dosage regimen have been somewhat lessened with the advent of individual unit dosage packaging, e.g., blister packages. Tablets and capsules which a pharmacist may have previously stored in large jars, and dispensed in small bottles with instruction labels to patients, may now be individually contained in a multi-layered strip package commonly known as a blister package. The individual compartments may be appropriately labeled to provide a degree of visual feedback which bottles cannot provide. However, substantial non-compliance with desired medication regimen persists as a major concern.

It has been suggested that monitoring patient adherence to an established medication regimen over an extended period of time will disclose inadequacies in the patient's compliance habits which may be corrected by the doctor through instruction to the patient. See Hanpeter et al., AAMI 17th Annual Meeting, May 9–12, 1982, pg. 44. Hanpeter discloses an electronic memory which records over an 85 day period (resolved into 15 minute intervals) when medicine was removed from a blister pack. This information is then obtained by a physician on a subsequent visit by the patient to the physician. Analyzing this data from the three month period, the physician then attempts to work with the patient to correct compliance deficiencies.

Hanpeter only discloses a method for monitoring compliance, but does not directly or electronically assist the patient in real-time compliance. Additionally, Hanpeter's suggested technique fails to address the problems of a substantial portion of medication users, i.e., those who take a prescription medication for a short time only, instead of prolonged periods of usage.

The problem of aiding patient compliance with a medication regimen has been addressed in the prior art with regard to non-blister package techniques. Various devices have included timer and alarm means, particularly with regard to bottles or other non-individual dosage packaging systems. Some examples of various medication timers are as follows:

Zoltan; U.S. Pat. No. 4,419,016 Dec. 6, 1983.
Machamer; U.S. Pat. No. 4,382,688 May 10, 1983.
Wirthschafter; U.S. Pat. No. 4,361,408 Nov. 30, 1982.
Carlson; U.S. Pat. No. 4,223,801 Sept. 23, 1980.
Glucksman et al.; U.S. Pat. No. 3,369,697 Feb. 20, 1968.

The present invention discloses a method and apparatus for a patient medication compliance aid, particularly suitable for use with individual dosage packaging, such as blister packs. A pharmacist, using information usually obtained from a physician's prescription, loads a medication timer with a desired dosage interval. The compliance aid monitors the contents of each individual unit compartment and alerts the patient at the proper time to take each dose of medicine. A display continuously shows the patient what the desired dosage interval is, and how much time is remaining in the present dosage interval before the next dose should be dispensed. A control and safety feature of the compliance aid allows the pharmacist to establish the desired dosage interval in accordance with the physician's prescription and prevent unauthorized changing of the desired interval.

Thus, the present invention provides an electronic compliance aid which is compatible with strip laminated blister packaging for medications, and which is inexpensive and practical for manufacture in large quantities. The electronic circuitry may be disposable for incorporation within an original unit-dose package, or the compliance aid may be fashioned in a layered device which could be applied to existing unit-dose packages which were not manufactured with the compliance aid built in. Additionally, the bulk of the electronic circuitry could be relatively remotely located from the package via a radio telemetry hookup between monitoring and transmitting means located on the package and timing, display and receiver means which may be carried separately by a patient.

Thus, an effective and reliable compliance aid is provided which is simple for the pharmacist to enable and explain operation thereof to the patient while requiring minimum effort from the patient in obtaining the benefits of the compliance assistance. The patient simply utilizes the pharmacist-engaged package as he would any other package, except that medication is taken whenever an alarm signal is provided. A display is provided to permit the patient or a family member, friend or physician, to readily ascertain the time remaining before the next dose should be taken.

These as well as other features and advantages of this invention may be better understood by reading the following detailed description of the presently preferred exemplary embodiment and the accompanying drawings, in which.

Figure 3:
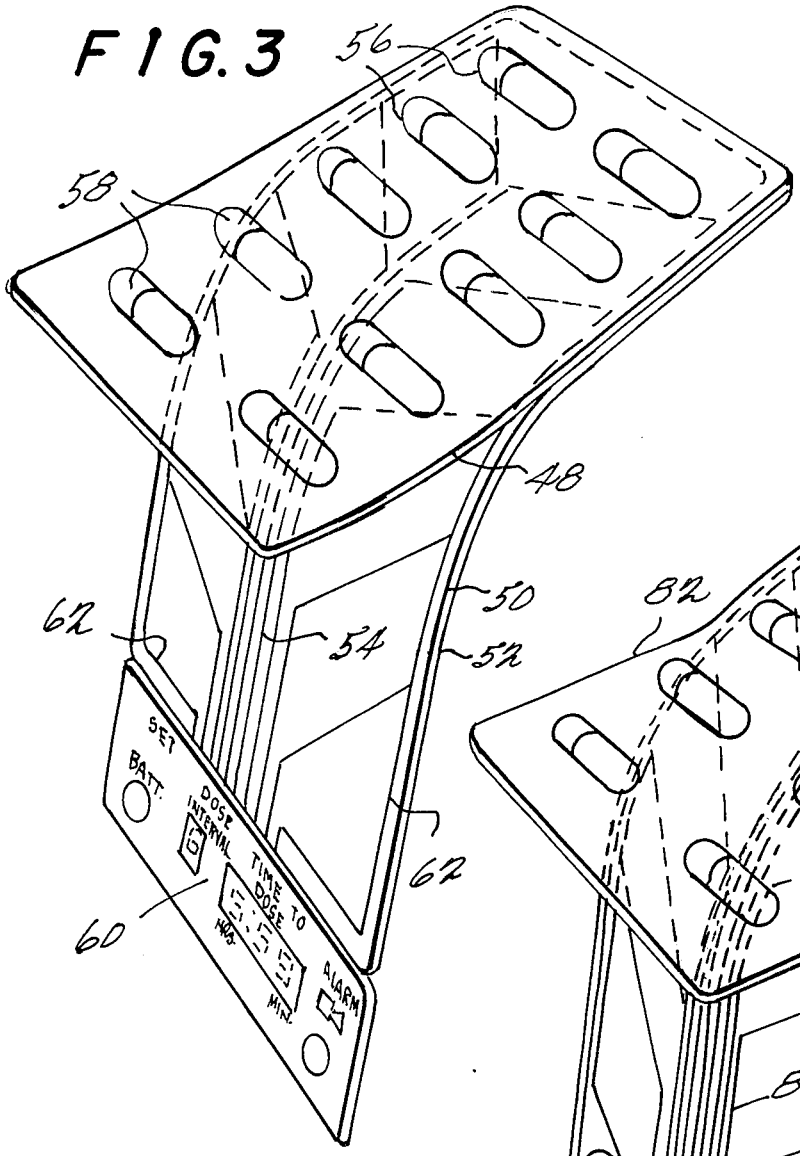
FIG. 3 is a pictorial representation of another embodiment of the present invention applied to an existing blister package.
Figure 6:
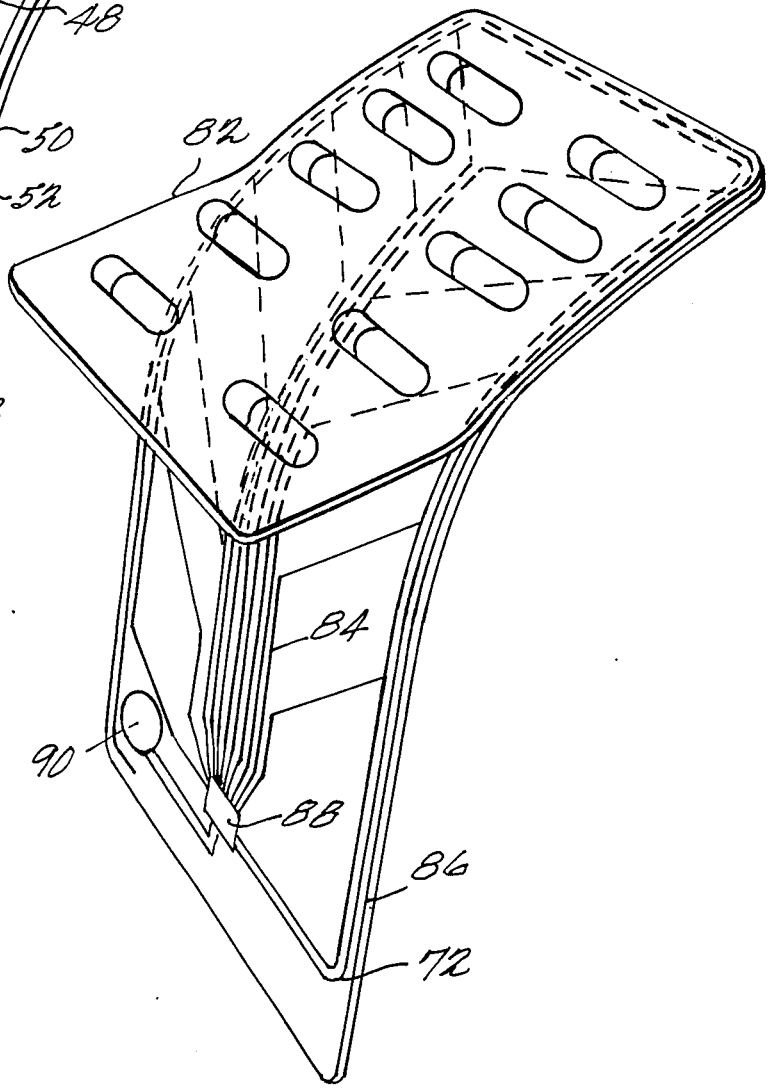
Figure 5:
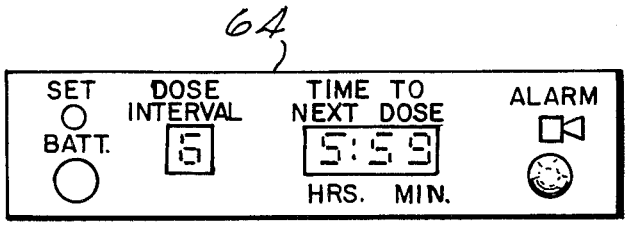
Figure 7:
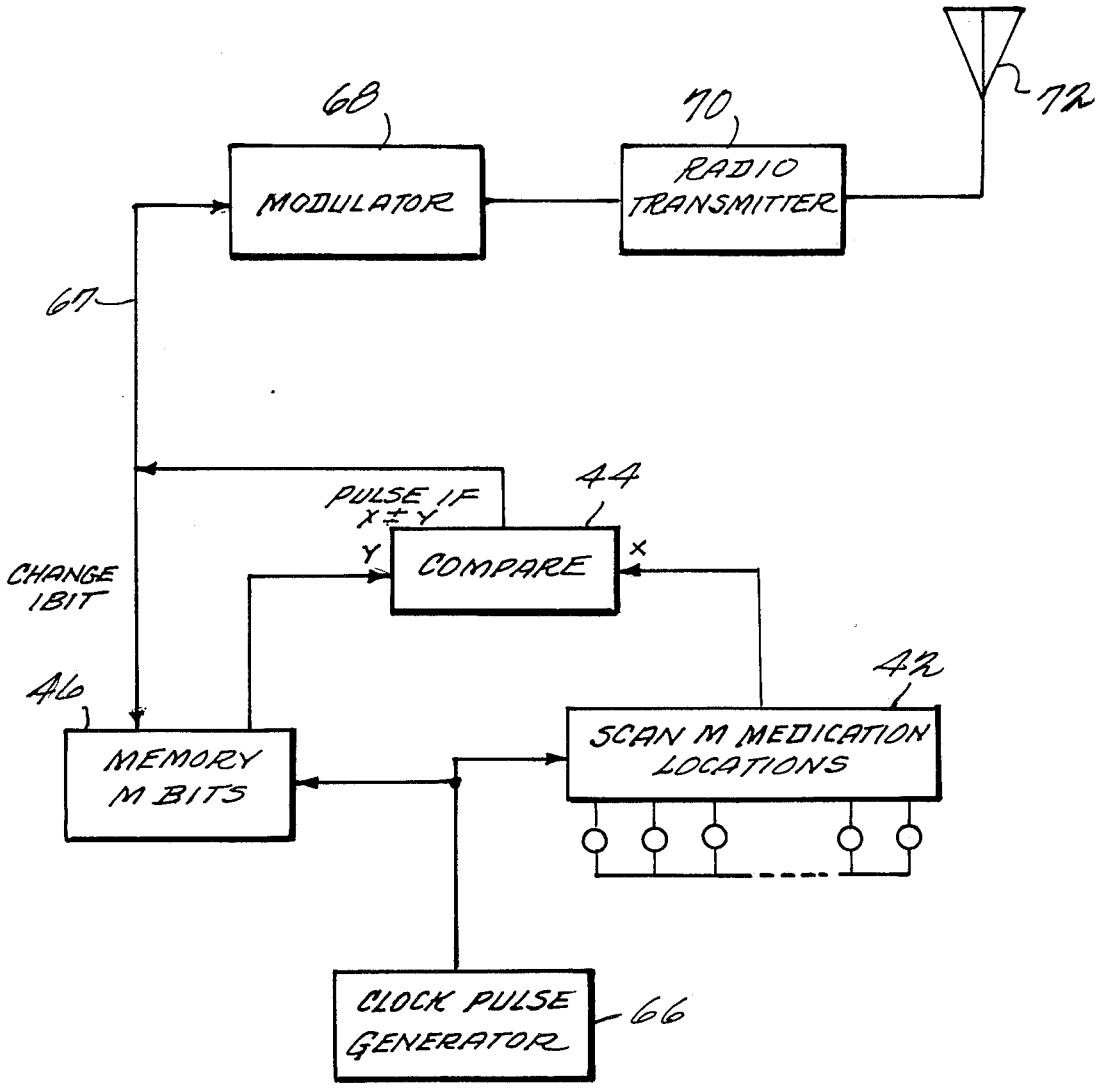
Figure 8:
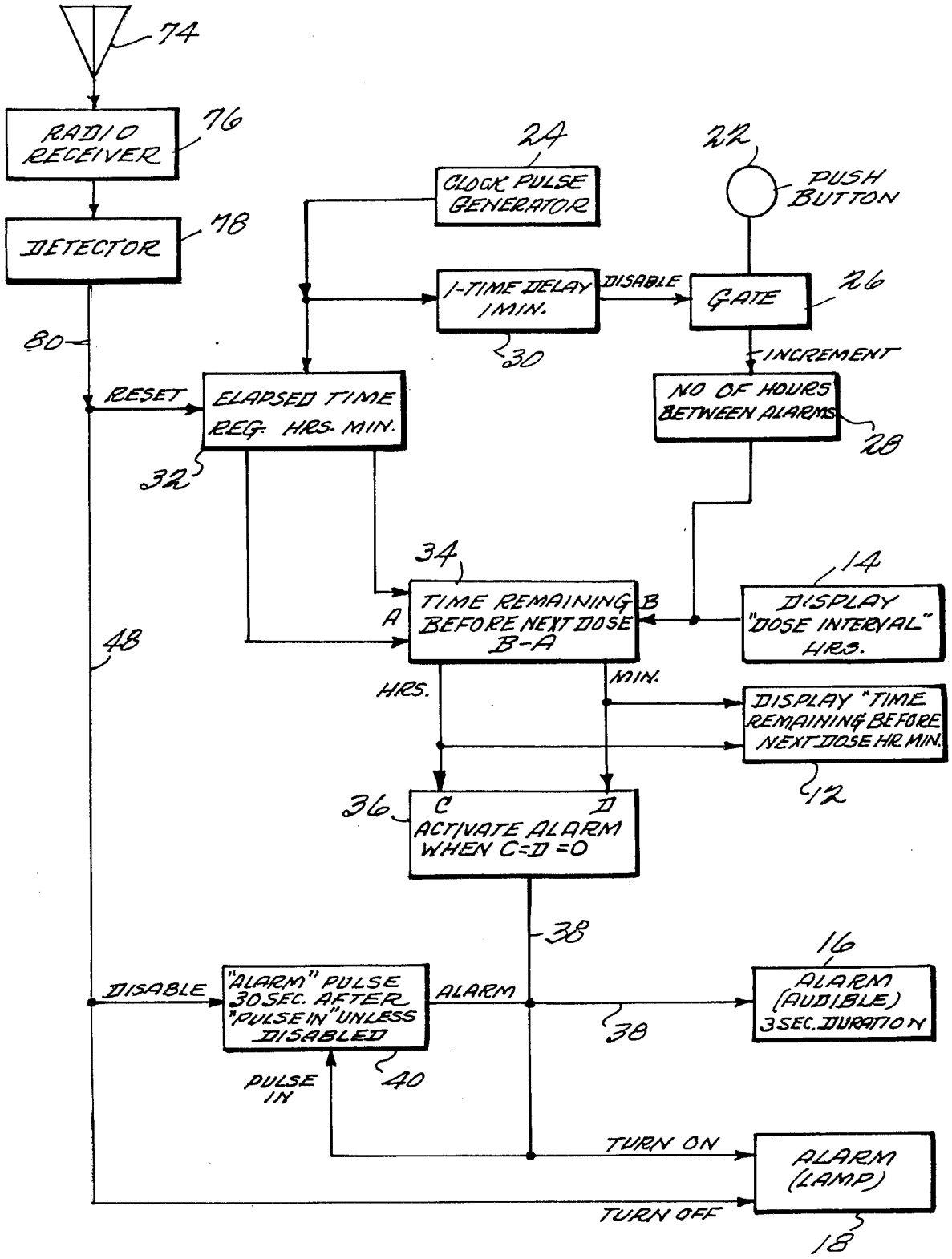

FIGS. 5 and 6 are an alternate embodiment of FIG. 3 utilizing a radio telemetry hookup; and FIGS. 7 and 8 are transmitter and receiver portions, respectively, for the embodiment of FIGS. 5 and 6.

Figure 1:
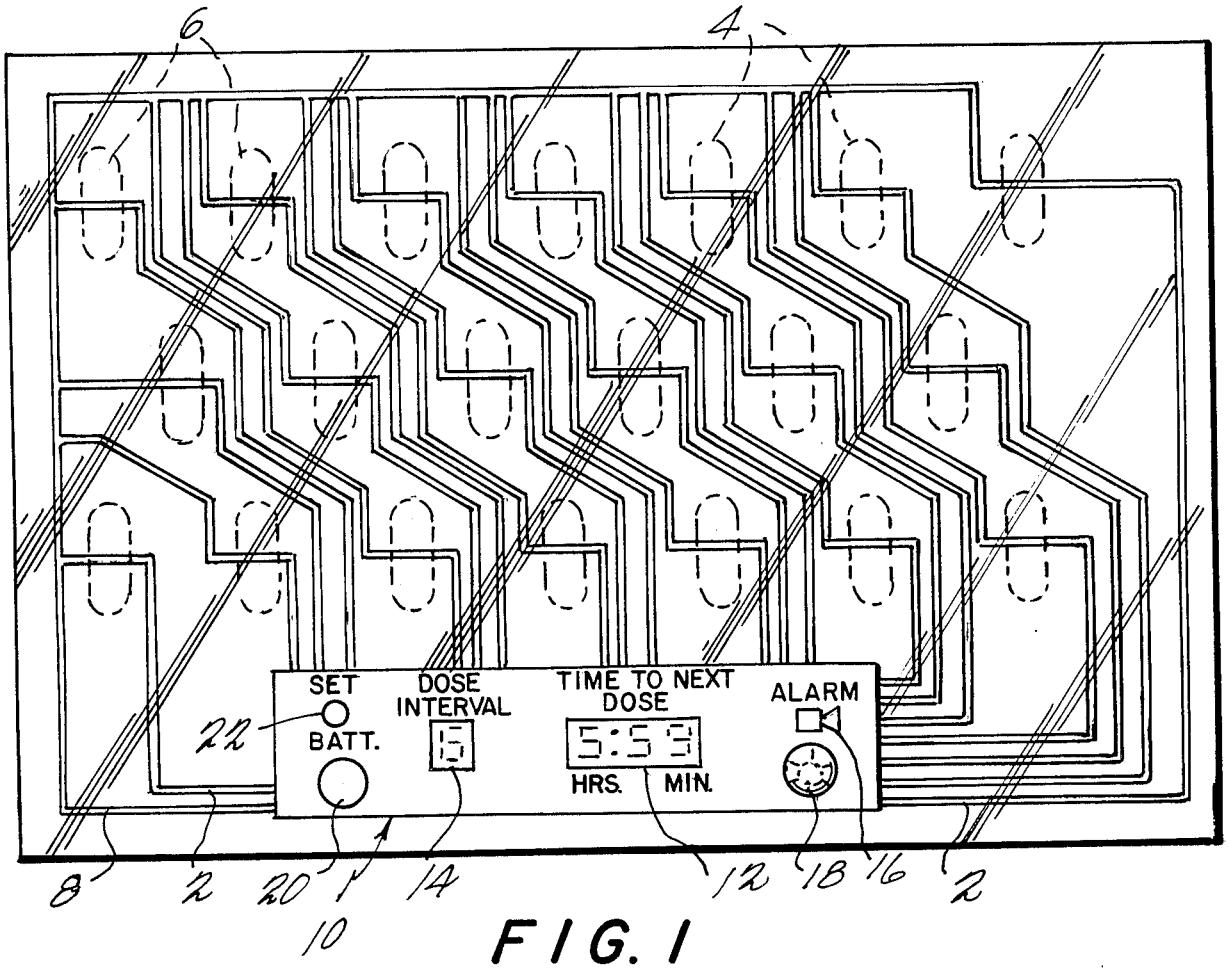
FIG. 1 is a side view of a presently preferred embodiment of the present invention incorporated into a blister package.

FIG. 1 shows the underside of a laminated blister package with medication tablets or capsules arranged therein, along with integrated circuitry and various output and control means in accordance with the present invention. The laminations of this modified blister package include a foil layer which contains conducting pathways connected to the electronic circuitry. Each conducting pathway 2 passes over the mouth of a different blister cavity 4. Each cavity 4 contains a separate unit of medication 6 (which may be capsules, tablets, pills, etc.). Each conducting pathway 2 is connected to a common bus 8 which makes a circumferential loop and returns to the central circuitry.

The medication holding portion of the blister package may be comprised of various plastic and cardboard layers, as is well known. The present invention adds additional layers to the structure of a conventional blister package to achieve individual monitoring of the various compartments 4. Conventional blister packages typically utilize a solid foil layer to prevent moisture from entering the various cavities. The present invention utilizes a non-conductive film layer to separate this solid foil layer from the conducting pathway foil layer comprising conductive elements 2 and 8. This conducting pathway foil layer also partially contains non-conductive portions in order to electrically separate the conducting pathways.

Circuitry mounted on the blister package of FIG. 1 is contained in solid housing 10. Additionally, numeric indicators 12 display the time remaining (in hours and minutes) before a next dose of medicine should be taken. Numeric display 14 constantly shows in hours the desired dosage interval which has been established. Audible alarm 16 and visible lamp alarm 18 let the patient know when the desired dosage interval has elapsed and it is time to take the next dose of medication.

A battery 20 is installed into the face of the housing 10 to power the circuitry contained therein. This battery may be a screw-in type mount (as is common in many camera applications) or a pop-in or secured type mount (as is common in many watch applications). Suitable means, such as a recessed housing or a lockable cover, many be employed to restrict access to the battery. This is important inasmuch as installation of the battery (by a pharmacist or other person) may constitute engagement of the medication timer to thereby establish a desired dosage interval. Thus, installation of this battery may constitute a portion of a control and safety feature of the present invention.

Pushbutton 22 is also used by the pharmacist (or other person) in establishing the desired dosage interval, along with engagement of the battery. This operation will be further explained.

Figure 2:
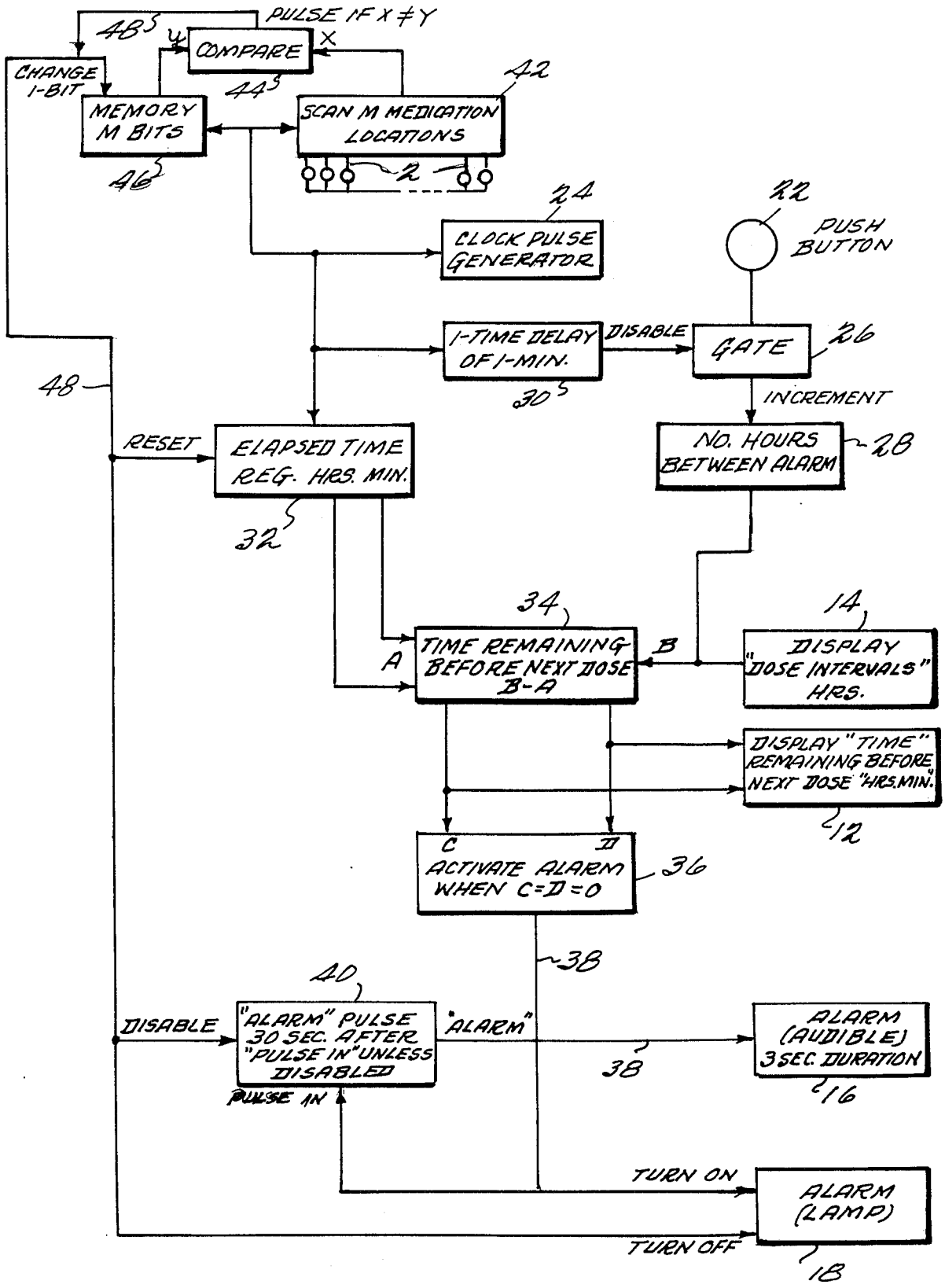
FIG. 2 is a block diagram of the electronic circuitry of FIG. 1.

Referring to FIG. 2, it may be seen that placing battery 20 in housing 10 activates the compliance aid and causes clock pulse generator 24 to produce pulses at a nominal frequency of 1 Kilohertz. Utilizing pushbutton 22 the pharmacist controls gate circuit 26 to establish, in increments of hours, the number of hours between alarms which is is to be held by register 28. The contents of register 28 will appear on numeric display 14 as the number of hours between alarms, i.e., the desired dosage interval.

Delay circuit 30 (receiving an input from clock pulse generator 24) provides a disable signal to gate 26 one minute after the battery 20 is placed in housing 10. After introduction of the disable signal to gate 26 from delay circuit 30, pushbutton 22 can no longer affect gate 26, and thus register 28. Accordingly, no further change in the number of hours between alarms is possible without removing the battery (access to which may be restricted) and replacing it again. Thus, a control and safety function of the present invention is thereby established.

With a desired dosage interval established, up-counter 32 begins to register elapsed time utilizing clocking pulses from clock pulse generator 24. Up-counter 32 provides two outputs, one representative of hours and the other minutes. Time remaining before the next dose should be dispensed is calculated in subtractor 34, which subtracts the elapsed time indicated by up-counter 32 from the number of hours between alarms which the pharmacist has set in register 28. The contents of subtractor 34 are shown on numeric display 12 as the "Time To Next Dose". This time is resolved into hours and minutes.

Whenever sufficient time has elapsed that all outputs from subtractor 34 are zero, comparator 36 emits an alarm pulse on line 38. Alarm lamp 18 and audible alarm 16 are signalled to turn on by the alarm pulse on line 38. This alarm pulse on line 38 further activates a delay flip-flop circuit 40 which produces another alarm pulse on line 38 thirty seconds after receiving its pulse input. The recurring alarm pulse on line 38 causes audible alarm 16 to sound for three seconds every thirty seconds. The alarm pulse on line 38 is fed back as a pulse input to delay flip-flop circuit 40, so that repetition of the audible and visible alarm continues until delay flip-flop 40 is disabled.

Activated by clock pulses from clock pulse generator 24, scanner 42 continuously makes a serial scan of all conducting pathways (lines 2 shown in FIGS. 1 and 2) associated with the various medication dosage compartments 4. Each of M medication compartments is scanned and the information obtained thereby subsequently provided to output X of scanner 42, which is an input to comparator 44. Memory 46 contains a 1-bit representation of the last-known status (empty or full) of each compartment. Memory 46 is synchronized with scanner 42 so that the contents of the M different bit addresses (shown on output Y of memory 46) are respectively compared with the X outputs of scanner 42. Output Y of memory 46 is another input to comparator 44. The output of comparator 44 remains zero so long as scanner 42 finds the same values at each of the M locations as are found in the respective memory addresses of memory 46. When these values differ, comparator 44 produces an output pulse which is sent to various other elements of the electronic circuitry.

Differing values occur whenever a patient has removed a medication unit from its compartment by pushing it through the conducting pathway foil layer of the present invention thereby interrupting the compartment's uniquely associated conducting line. This will cause the scanner to find a different value for the respective medication location status than that stored respectively in memory 46. With X not equal to Y for that medication compartment, comparator 44 produces a reset pulse (change 1-bit) on line 48 which causes memory 46 to change the respective bit value for the medication compartment presently scanned. Thus, the scanner 42 updates the memory 46 with regards to the contents of the medication compartments 4, and effectively alerts the compliance aid circuitry whenever a dosage of medicine is removed (and presumably taken).

The remaining circuitry is alerted to the removal of medication by the reset pulse from comparator 44 also resetting the elapsed time register 32 to zero. The reset pulse on line 48 also turns off the alarm lamp 18 and disables delay flip-flop circuit 40, thereby stopping the repetition of pulses to audible alarm 16.

Thus, in operation, when the medication regimen as established by the desired dosage interval indicates that a dose of medicine should be taken, an audible alarm of three seconds is produced every thirty seconds until the patient removes a medication unit from the blister package, any of the medication compartments. Lamp alarm 18 is turned on at the time of the first alarm and turned off when the medication is removed from the package.

FIG. 3 shows another embodiment of the present invention which permits the electronic circuitry (with associated alarms, displays and control means) of the present invention to be applied to a previously existing conventional blister package. Package 48 is representative of those typically provided presently by pharmaceutical companies, with multiple-compartments of individual doses of medicine.

Figure 4:
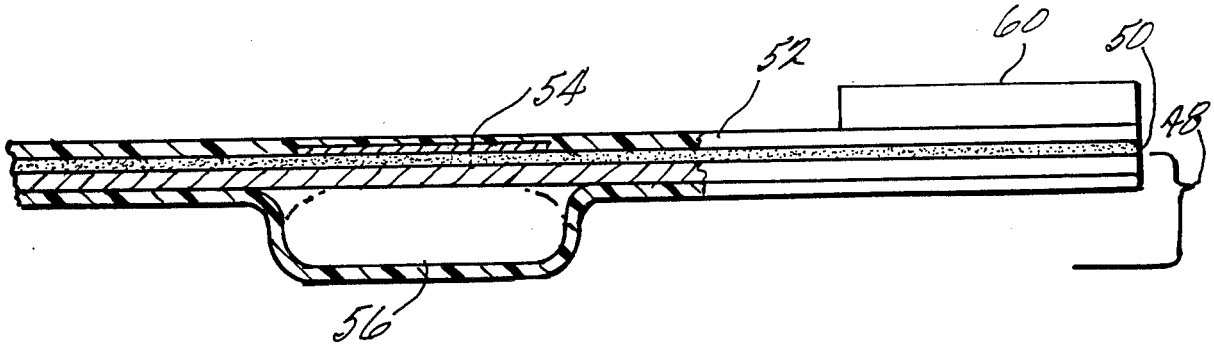
FIG. 4 is an edge view showing the lamination structure of the embodiment of FIG. 3.

This embodiment utilizes precisely the same electronic circuitry as disclosed in FIG. 2, supra. In this particular embodiment, the conductive foil pathways (2 and 8 in FIG. 1) are contained within or adjacent to an adhesive strip of appropriate size and shape to be applied to the foil back of a conventional blister package. As shown in FIGS. 3 and 4, this adhesive strip contains two layers. They may include a non-conductive layer 50 comprised of an adhesive substance and a second layer (or backing layer) 52 which contains conductive foil material comprising conducting pathways 54. As shown in FIG. 3, these pathways are arranged such that application of the adhesive strip to the back of the blister package 48 will cause each conductive element to pass over the mouth of a single cavity 56. Each cavity 56 contains its own respective dose of medicine 58. In the same manner as is shown in FIG. 1, each conductive pathway 54 of FIG. 3 is connected back to the electronic circuitry contained within housing 60. Common bus pathway 62 provides this return to the electronic circuitry for each individual pathway 54.

The pharmacist (or other person) would apply the entire device to the back of an existing blister package, as is shown in FIG. 3. Enablement of the compliance aid would be by installation of the battery and using push-button 22 to set the dosage interval, as described with reference to FIGS. 1 and 2. The patient then would use the device in precisely the same fashion as previously described. Removing medication from the blister package would require the patient to push the individual dosage through the solid foil backing (which is part of the original blister package) and also through the adhesive layer and the second (backing) layer containing the foil conductor 54 respective to that particular cavity 56. Thus, a particular foil conductor 54 is interrupted as medicine is removed from its respective compartment. Remainder of the operation of this embodiment is precisely the same as that for the embodiment of the integrally housed compliance aid of FIGS. 1 and 2.

FIG. 4 shows a cross-sectional view of a single cavity and it surrounding area. This FIGURE clearly shows the relationship of the existing conventional laminated package (blister package) with the layers of the present invention. Cavity 56 is formed within a plastic layer which is generally clear to permit the medication within the cavity to be viewed. The layer in direct contact with the plastic is usually made of solid metal foil to prevent the passage of water into the cavities, which water could adversely affect the enclosed medication. These two layers together constitute the conventional blister package 48 of FIG. 3.

The remaining layers shown in FIG. 4 represent the additional layers which are applied to the existing conventional blister package. Non-conductive layer 50 comprised of adhesive material is directly applied to existing blister package 48. This layer provides the necessary insulation between the solid metal foil layer of the existing blister package and the partially conductive secondary (or backing) layer 52 of the present invention. This secondary layer 52 of the present invention also contains insulating material to separate the various foil conductors 54, as is shown in FIG. 3. These materials possess sufficient tensile strength to resist tearing during application to the back of the blister package, but are freely fracturable to allow a tablet or capsule to be pushed through the layer by a patient. Housing 60 of FIG. 4 is the same as shown in FIG. 3.

FIGS. 5 through 8 show a variation of the FIGS. 3 and 4 embodiment which permits the patient to retain housing 64 in a location relatively remote from the blister package device of FIG. 6, e.g., stored in a purse or pocket. The housing 64 of FIG. 5 contains all of the circuitry indicated in FIG. 8, which will be discussed further below. This circuitry is substantially identical to a portion of FIG. 2, with repeated reference numerals referring to identical elements. Accordingly, these repeated elements need not be described again inasmuch as their functions are previously explained.

FIGS. 7 and 8 collectively constitute the essential circuitry of FIG. 2, with the addition of a basic radio telemetry hookup. Clock pulse generator 66 of FIG. 7 provides signals to scanner 42 and memory 46, as was described with regard to FIG. 2. The output line of comparator 44 is referenced as 67 in FIG. 7. Output line 67 provides an input to modulator 68, which in turn feeds radio transmitter 70. The output of radio transmitter 70 is fed to antenna 72. The FIG. 7 circuitry is contained in an integrated circuit chip 88 (FIG. 6) which resides with the adhesive porton of the invention shown in FIG. 6.

Pick-up antenna 74 of FIG. 8 receives signals transmitted from the circuitry of FIG. 7, and feeds these signals to receiver 76 which subsequently feeds detector circuit 78. The output line of detector 78 is line 80. Line 80 then feeds line 48, which is the same as was shown in FIG. 2. The remaining description of FIGS. 7 and 8 is identical to that for FIG. 2. The FIG. 8 circuitry is contained in housing 64 (FIG. 5) which may be carried separately by a patient. The arrangement of FIGS. 7 and 8 permit the timer, display and alarm means of FIG.

8 to be relatively remotely located from the FIG. 7 electronic circuitry, which is directly associated with the blister package itself. FIGS. 5 and 6 clearly show this relationship.

In FIG. 5, housing 64 is virtually the same as housing 10 of FIG. 1, including comprising identical control means, display and alarm means. FIG. 6, however, is more closely related to the embodiment of FIG. 3 inasmuch as the adhesive layer embodiment may be applied to existing blister package 82. The conducting pathways 84 of FIG. 6 are the same as conducting pathways 54 of FIG. 3. These pathways are contained within adhesive strip 86, and are functionally identical with those of the embodiment of FIG. 3. Integrated circuit 88 of FIG. 6 does not contain the alarms, displays or controls of FIG. 8. However, there is a lockable compartment 90 which receives a battery to power the electronic circuitry of FIG. 6.

The electronic circuit elements of chip 88 are as shown in FIG. 7 (discussed above). The electronic circuitry contained within housing 64 of FIG. 5 is as shown in FIG. 8 (discussed above). One of the functional differences between this embodiment and the previous embodiments is that the secondary backing layer of FIG. 6 requires inclusion of flexible antenna 72 to enable the radio telemetry link-up with the receiver circuit of FIG. 8. Accordingly, the housing 64 of FIG. 5 has an antenna 74 contained therein (not shown). Otherwise, the circuit elements of this embodiment perform precisely as described for the previous FIGURES.

One advantage of providing an alarm-display module physically separate from the rest of the compliance aid is that the alarm-display module 64 may be reuseable. Additionally, the battery from the adhesive strip portion may be salvaged by the patient for use in the next adhesive strip. Accordingly, only the small integrated chip 88 along with its foil conductors and battery compartment need be disposable.

Although several exemplary embodiments have been described in detail, those skilled in the art will appreciate that many variations and modification may be made without departing from the advantages and novel features of the present invention. For example, access to battery 20 may be controlled with some turnkey device, not universally available to the general public, which would increase the level of security with regard to the establishment of a desired dosage interval. Also, the timer means could be expanded to include day information for medicine which might need to be taken only once every several days. All such modifications and variations are intended to be included within the scope of the appended claims.

What is claimed is:

1. A medication dispenser, comprising:

multi-compartment container means for housing an individual dose of medicine in each compartment, and for permitting random access to said compartments and dispensing of their contents;

timer means for timing a desired time period between dispensing of said doses of medicine, and generating a signal at the end of said desired time period;

alarm means for sounding an alarm in response to said signal from said timer means; and scanning and memory means for scanning said compartments and recording whether said individual doses of medicine have been dispensed:

said dispenser further including setting means for setting said desired time period for said timer means, thereby establishing a dosage interval;

safety means to prevent unauthorized or accidental control of said setting means;

said safety means being engaged by the installation of a battery in said medication dispenser.

2. A dispenser as in claim 1, further comprising:

display means for displaying the established dosage interval and the remaining time before the end of said desired time period.

3. A dispenser as in claim 2, further comprising:

sensor means for sensing each compartment for the presence of its respective dose of medicine; and wherein said container means comprises a blister package with M number of compartments; and said memory means has M bits of storage corresponding respectively to said M compartments.

4. A dispenser as in claim 3, wherein:

said blister package has a number of lamination layers, one of which is comprised of foil having M number of separate conducting pathways, each one of which pathways respectively corresponds to one of the M compartments; and said display means is integrally incorporated into layers of the blister package so as not to protrude therefrom.

5. A dispenser as in claim 4, wherein:

said blister package is an existing conventional multilayer container means, and the remainder of said layers form a unit which is selectively applied with adhesive to said existing blister package.

6. A dispenser as in claim 4, wherein:

said display means possesses a visual and/or audible alarm device responsive to the alarm means;

said dispenser includes means for removably receiving a battery; and said display means is powered by said removable battery.

7. A dispenser as in claim 3, further including:

update means for updating the dispense information stored in the memory in response to the sensor means.

8. A laminated blister package dosage control system comprising:

a blister package with M number of compartments;

memory means with M bits of storage, which bits respectively correspond with said compartments;

sensing means for sensing whether a particular compartment is filled;

update means for storing in said memory data concerning whether the individual compartments are filled, said update means being responsive to the sensing means;

timer and alarm means for timing a desired dosage interval, sounding an alarm at the end of said dosage interval, and resetting the timing function whenever the sensing means senses that a compartment has been emptied:

said timer and alarm means further including safety means for preventing unauthorized or accidental establishment of a dosage interval, wherein said safety means is is engaged by the installation of a battery in the medication dispenser.

9. A system as in claim 8, further comprising:

display means for displaying said desired dosage interval, and the amount of time remaining till the end of a dosage interval.

* * * * *